United States Patent [19]

Hoople

[11] 4,130,823

[45] Dec. 19, 1978

[54] MINIATURE, FLUSH MOUNTED, MICROWAVE DUAL BAND CAVITY BACKED SLOT ANTENNA

[75] Inventor: Gary R. Hoople, San Jose, Calif.

[73] Assignee: The United States of America as represented by the Secretary of the Navy, Washington, D.C.

[21] Appl. No.: 822,105

[22] Filed: Aug. 5, 1977

[51] Int. Cl.[2] ..... H01Q 13/18

[52] U.S. Cl. ..... 343/768; 343/789

[58] Field of Search ..... 343/767, 768, 789, 708, 343/872

[56] References Cited

U.S. PATENT DOCUMENTS 4,054,876 10/1977 Hoople ..... 343/789

*Primary Examiner*—Eli Lieberman

*Attorney, Agent, or Firm*—R. S. Sciascia; Charles D. B. Curry; Francis I. Gray

[57] ABSTRACT

A miniature, flush mounted, microwave dual band antenna which radiates omnidirectional microwave signals from a single flush mounted cylindrical array at frequency bands separated by 1.5 octaves. The antenna has a Y-shaped cavity with the leg of the Y being taken up by a probe and surrounding dielectric block. The cavity resonates the lower frequency band energy primarily in the open non-dielectric spaces and resonates the higher frequency band energy primarily in the dielectric space.

3 Claims, 4 Drawing Figures

MINIATURE, FLUSH MOUNTED, MICROWAVE DUAL BAND CAVITY BACKED SLOT ANTENNA

BACKGROUND OF THE INVENTION

1. Field of the Invention

The present invention relates to microwave antennas, and more particularly to a flush mounted dual frequency band antenna.

2. Description of the Prior Art

Prior design art for dual frequency-dual mode antennas has been defined by several authors in the IEEE Transactions on Antennas and Propagation: Wolfgang H. Krammer described the properties of half wave slots in a two mode rectangular waveguide in the March 1973 issue; and Maurice L. Fee reported the design of a dual frequency trough waveguide in the November 1972 issue. Other design methods for antennas that radiate frequency bands separated by greater than an octave include log periodic antennas and cavity backed spiral antennas.

SUMMARY OF THE INVENTION

Accordingly, the present invention provides a miniature, flush mounted, microwave dual band antenna having a Y-shaped cavity. The leg of the Y is taken up by a probe and surrounding dielectric block. The cavity resonates the lower frequency band energy primarily in the open non-dielectric spaces and resonates the higher frequency band energy primarily in the dielectric space. The cavity guides energy to an aperture plate which contains a resonant slot for final transformation to free space. The aperture plate also polarizes the radiated energy.

Therefore, it is an object of the present invention to provide a cavity antenna of minimal depth having normal gain and normal bandwidth in two frequency bands.

Another object of the present invention is to provide a dual frequency band antenna that efficiently radiates energy within a wide beamwidth.

A further object of the present invention is to provide a dual frequency band antenna having one input port and one output port and an independent flow of energy in two frequency bands.

Other objects, advantages and features of the present invention will be apparent from the following detailed description read in view of the drawing and following claims.

DESCRIPTION OF THE PREFERRED EMBODIMENT

Figure 1:
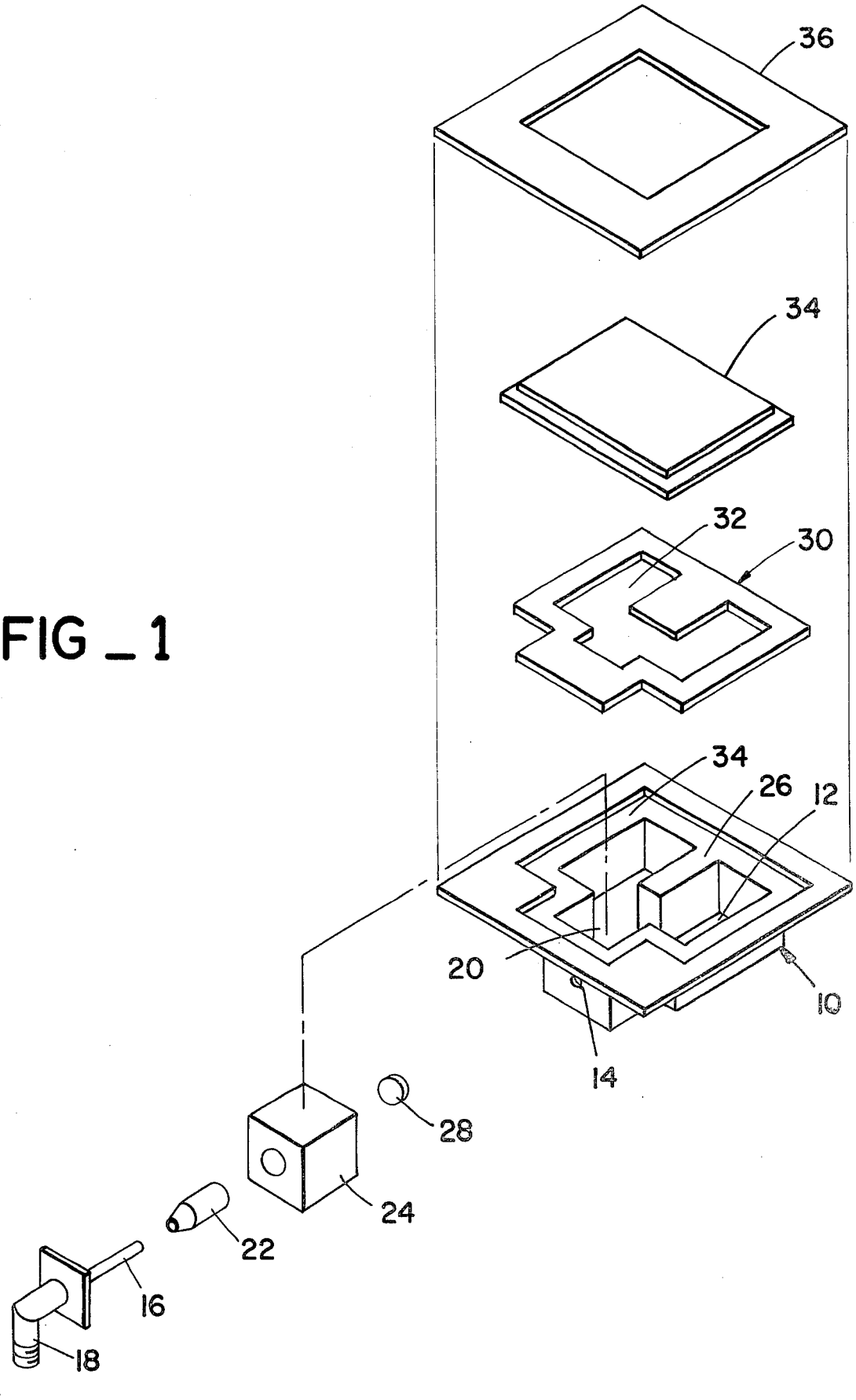
FIG. 1 is an exploded perspective view of a dual frequency band antenna.
Figure 2:
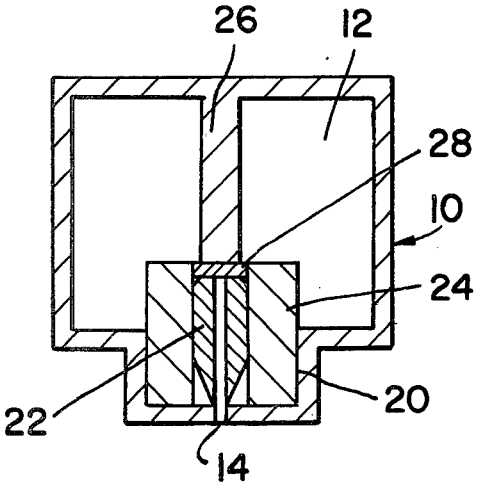
FIG. 2 is a top cross-sectional view of the antenna of FIG. 1.

Referring now to FIGS. 1 and 2 a metallic antenna body 10 has an approximately Y-shaped cavity 12 of depth, d. An input port 14 is centrally located in the base of the Y-shaped cavity 12 to provide a point of entry for a stem 16, which is the center conductor of an rf transmission line 18, into the leg or well 20 of the cavity. A probe 22, made of copper or other conducting material, of cylindrical shape with one conical frustum end having an axial hole therethrough fits tightly around the stem 16. A block 24 of dielectric material having a central cylindrical hole therethrough in turn fits tightly around the probe 22. The block 24 fits into the well 20 and extends to rest against a vane 26 which forms the divider for the two arms of the cavity 12. A dielectric plug 28 fits into the end of the hole in the block 24 to provide electrical insulation between the probe 22 and the vane 26. The dielectric block 24 serves to electrically lengthen the probe 22, electrically increasing the cavity size and insulating the probe. The probe 22 transfers energy from a low characteristic impedance of a r.f. connector, typically 50 ohms, into a higher internal cavity impedance for the two frequency bands, typically approximately 725 ohms for an E band frequency TE mode and 500 ohms for a G band frequency hybrid TM mode. The stem 16 provides the r.f. energy excitation for the probe 22.

A metallic aperture plate 30 having a slot 32 fits snugly into a groove 34 surrounding the cavity 12 to completely enclose the cavity except for the slot. A dielectric window 34 covers the slot 32, and a cover 36 having an opening to accommodate the window is attached to the antenna body 10 to hold the window and aperture plate 30 in place. The cavity 12 guides energy to the aperture plate 30 with the resonant slot 32 providing the final equivalent circuit transform to a free space 377 ohm characteristic impedance. The aperture plate is designed for a weighted Q of about 23 at E band frequencies and a weighted Q of about 5 at G band frequencies to insure efficient antenna operation and the desired low frequency band directivity.

Figure 3:
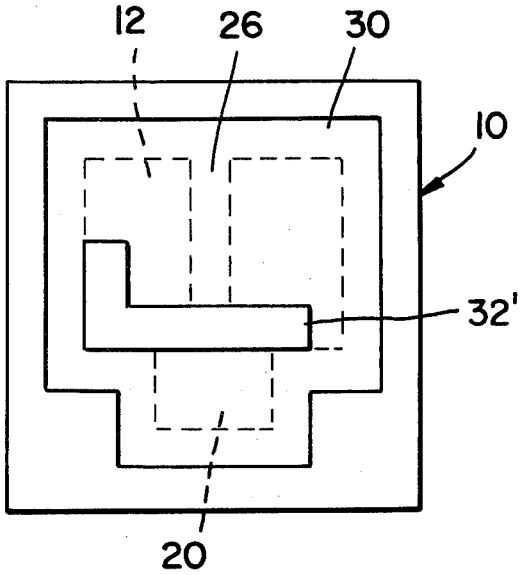
FIG. 3 is a top plan view of an alternate aperture plate for a dual frequency band antenna.

FIG. 3 shows the aperture plate 30 with a different L-shaped slot 32'. Changing the slot configuration changes the polarization of the radiated energy to fit a particular application. For example, slot 32 of FIG. 1 radiates energy which is linearly polarized parallel to the stem 16 in both frequency bands, while slot 32' radiates energy in the lower frequency band which is linearly polarized but is rotated approximately 45°.

The dimensions of the cavity 12, expressed in terms of wavelength, are approximately as follows, with $\lambda_1$ being the approximate wavelength of the lower frequency band and $\lambda_2$ being the approximate wavelength of the upper frequency band. The width of the leg or well 20 and the length from the tip of the vane to the base of the well are approximately $\lambda_2/1.25$. The width across the top of the Y-shaped cavity 12 is approximately $\lambda_1/2$, but more importantly the length from the tip of one arm around the vane 26 to the tip of the other arm is approximately $\lambda_1/1.5$.

In operation the antenna operates by resonating energy in two modes of propagation. The lower frequency band of energy resonates in the transverse electric mode, $TE_{01}$. This common mode of propagation contains a transverse electric component and two magnetic components, one axial and the other transverse. The slot 32 in the aperture plate 30 couples to the current produced by the transverse magnetic component and transfers energy to free space.

The higher frequency band of energy resonates in a mode similar to that described by R. Harrington in "Time Harmonic Electromagnetic Fields," McGraw-Hill, at page 152 as a hybrid transverse magnetic mode, $TM_{X11}$. This mode of propagation contains three electric components, two transverse and one axial, and two magnetic components, one transverse and one axial. The slot 32 couples to the current produced by the transverse magnetic component, independently of the energy in the lower frequency band, and transfers energy to free space.

Figure 4:
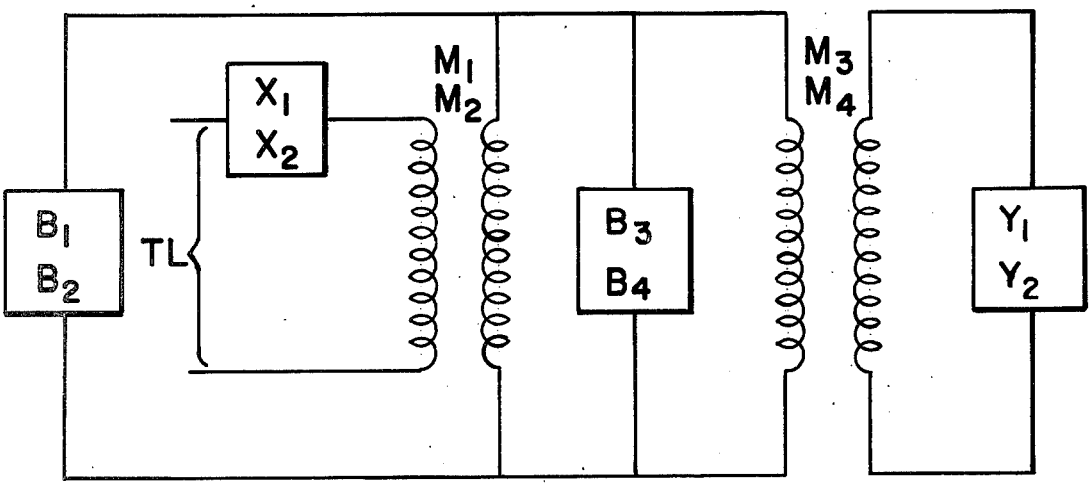
FIG. 4 is an electrical schematic of the equivalent circuit for the dual frequency band antenna.

FIG. 4 shows an equivalent circuit for the antenna. The lines, TL, represent the coaxial rf transmission line 18 from the source (not shown). In the following discussion the odd subscripts are associated with the lower frequency band and the even subscripts with the higher frequency band. The combined reactance of the well 20 and the probe 22 are denoted by $X_1$ and $X_2$. $M_1$ and $M_2$ represent the transfer of energy from the probe 22 to the cavity 12. $B_1$ and $B_2$ represent the susceptance component due to the short circuit formed by the back wall of the antenna body 10. $B_3$ and $B_4$ represent the susceptive component of admittance due to the open circuit formed by the slot 32. $M_3$ and $M_4$ denote the transfer of energy from the cavity 12 to free space through the slot 32. $Y_1$ and $Y_2$ represent the admittance forward by the slot 32.

$B_1$ and $B_2$, the short circuit susceptive component of admittance, are inductive and $B_3$ and $B_4$, the open circuit susceptive component of admittance, are capacitive. At the higher frequency band $B_2$ and $B_4$ effectively cancel each other, presenting no impedance matching problems. At the lower frequency band $$B_1 = \frac{i}{z_o \tan kd} \quad (1)$$

$$B_3 = \frac{i}{z_o \operatorname{cotan} kd} \quad (2)$$

where $k=2\pi/\lambda_1$ and $z_o$ is the internal characteristic impedance of the cavity 12.

The reactive component of impedance may be expressed as $$X_1 = z_o/2I_n^2(\int\int J_s \cdot \bar{e}_o ds)^2 \quad (3)$$

where $I_n$ is the input current from TL, $e_8$ is the dominant cavity mode vector (voltage vector in the cavity), $J_s$ is the probe current vector modified by the well 20 to change equation (3) from normally capacitive to inductive, and ds represents an infinitesimal element of the interior surface of the cavity 12.

The expressions for $B_1$ and $B_3$ indicate that as d is decreased, i.e., the thin cavity condition is approached, $B_3$ approaches zero and $B_1$ approaches infinity. Thus, a very large capacitive element of impedance, $1/B_3$, is generated, preventing the transfer of energy to a free space traveling wave from the cavity 12. $1/B_1$, which is neglible for small d, cannot cancel out $1/B_3$. However, by appropriate design of the well 20 an inductive component is placed in parallel with $B_3$ to negate the susceptive term and form a resonant cavity circuit.

For a lower frequency band of 2200 to 2300 MHz and a higher frequency band of 5400 to 5900 MHz radiation patterns were measured in an anechoic chamber with isotropic gain reference established according to the gain substitution method. The aperture plate 30 of FIG. 3 with the L-shaped slot 32' was used in the antenna with an end to end length, l, greater than $\lambda_1/2$ in the dielectric window 34. With a rotating linear horn as an illuminating source peak gain was +5dB at 2250 MHz and +7dB at 5735 MHz, indicating normal gain and efficient radiation in both frequency bands. Also, the voltage standing wave ratios (VSWR) did not exceed 2:1 in either frequency band which, being less than 2.75:1, constitutes a practical efficiency with a loss of less than 1dB in radiated power.

The cut-off frequencies for the respective frequency bands are $\lambda_c=1.33\lambda_1$ in the non-dielectric spaces of the cavity 12, and $\lambda_c=1.12\lambda_2$ in the dielectric block 24. Beamwidth at 10dB from peak gain was measured as 180° and 220° in the E-plane and as 80° and 160° in the H-plane for the higher and lower frequency bands, respectively, providing the wide beamwidths characteristic of an omnidirectional antenna.

Therefore, the probe 22 and the well 20 form a mode transducer by allowing energy from the rf transmission line 18 to be efficiently converted to the $TE_{01}$ mode in the lower frequency band and to the $TM_{X11}$ mode in the higher frequency band.

What is claimed is:

1. A miniature, flush mounted, microwave dual band antenna comprising:

(a) an antenna body of a conductive material having an approximately Y-shaped cavity with a central vane and having an input port at the base of said Y-shaped cavity;

(b) a block of a dielectric material having a central hole, said block being situated in the leg of said Y-shaped cavity with said central hole aligned with said input port;

(c) a probe situated within said hole in said block and electrically insulated from said central vane, said probe having a central hole aligned with said input port into which the center conductor of a coaxial rf transmission line is inserted to excite said probe so that when said probe is excited said antenna resonates a lower frequency band energy primarily in the open non-dielectric spaces of said cavity, and resonates a higher frequency band energy primarily in the dielectric space of said block;

(d) an aperture plate having a slot enclosing the open end of said cavity, the configuration of said slot being a function of the desired polarization of the energy radiated in the lower frequency band;

(e) a dielectric window which covers said slot; and (f) a cover having an opening to accommodate said dielectric window which is attached to said antenna body to hold said dielectric window and said aperture plate in place.

2. A dual band antenna as recited in claim 1 further comprising a dielectric plug in the central hole of said block between the end of said probe and said central vane to insure electrical insulation of said probe from said central vane.

3. A dual band antenna as recited in claim 2 wherein said slot comprises an L-shaped configuration having a length from end to end greater than one-half the wavelength of the lower frequency band in said dielectric window.

* * * * *